US009530541B2

(12) United States Patent
McMahon et al.

(10) Patent No.: US 9,530,541 B2
(45) Date of Patent: Dec. 27, 2016

(54) CABLE WITH SPRING STEEL OR OTHER REINFORCEMENT MEMBER(S) FOR STABLE ROUTING BETWEEN SUPPORT POINTS

(71) Applicant: Raytheon Company, Waltham, MA (US)

(72) Inventors: Roy P. McMahon, Indianapolis, IN (US); Joseph C. Kurek, Zionsville, IN (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/622,497

(22) Filed: Feb. 13, 2015

(65) Prior Publication Data

US 2016/0240281 A1 Aug. 18, 2016

(51) Int. Cl.

| | |
|---|---|
| ***H01B 7/22*** | (2006.01) |
| ***H01B 7/04*** | (2006.01) |
| ***H01B 13/26*** | (2006.01) |

(52) U.S. Cl.

CPC ..... *H01B 7/226* (2013.01); *H01B 7/04* (2013.01); *H01B 13/26* (2013.01)

(58) Field of Classification Search

USPC ..... 174/128, 129, 70 R

See application file for complete search history.

(56) References Cited

U.S. PATENT DOCUMENTS

| | | | | |
|---|---|---|---|---|
| 327,487 | A | 9/1885 | Spalding | |
| 2,185,944 | A * | 1/1940 | Holmes | A62C 37/48 174/113 R |
| 2,321,021 | A * | 6/1943 | Dyer, Jr. | H01B 5/104 174/128.1 |
| 3,261,908 | A * | 7/1966 | Roche | H01B 5/08 174/128.1 |
| 3,647,939 | A * | 3/1972 | Schoerner | C22C 21/00 174/128.1 |
| 3,659,038 | A * | 4/1972 | Shealy | H02G 7/14 174/128.1 |
| 3,678,177 | A * | 7/1972 | Lawrenson | H01B 11/00 174/113 AS |

(Continued)

OTHER PUBLICATIONS

"NextGen Brand Outside Plant Cables" by CablesPlus, LLC www.CablesPlusUSA.com printed Feb. 13, 2015, pp. 12.

(Continued)

*Primary Examiner* — William H Mayo, III
*Assistant Examiner* — Krystal Robinson

(57) ABSTRACT

An apparatus includes a cable having at least one signal transport line and at least one reinforcement member. The at least one signal transport line is configured to transport one or more signals through the cable. The at least one signal transport line and the at least one reinforcement member are twisted in a common direction around a central axis of the cable, where the central axis extends in a longitudinal direction along a length of the cable. A twist rate of the at least one signal transport line substantially equals a twist rate of the at least one reinforcement member. At least part of each signal transport line is physically located between adjacent twists of each reinforcement member in the longitudinal direction of the cable.

20 Claims, 3 Drawing Sheets

(56) References Cited

U.S. PATENT DOCUMENTS

| | | | | | |
|---|---|---|---|---|---|
| 3,758,704 | A * | 9/1973 | Naud | H01J 31/065 | 174/102 E |
| 3,798,350 | A | 3/1974 | Clarke | | |
| 3,843,829 | A | 10/1974 | Bridges et al. | | |
| 3,983,521 | A * | 9/1976 | Furuto | H01L 39/14 | 174/125.1 |
| 3,991,550 | A * | 11/1976 | Cohen | D07B 5/005 | 174/42 |
| 4,199,224 | A | 4/1980 | Oestreich | | |
| 4,408,444 | A * | 10/1983 | Baillievier | D07B 1/062 | 57/211 |
| 4,689,444 | A * | 8/1987 | Burgess | H01B 5/08 | 174/128.1 |
| 5,133,034 | A | 7/1992 | Arroyo et al. | | |
| 5,325,457 | A | 6/1994 | Bottoms, Jr. et al. | | |
| 6,147,303 | A * | 11/2000 | Abe | G02B 6/4419 | 174/117 R |
| 6,674,011 | B2 * | 1/2004 | Ueno | H01B 7/0009 | 174/128.1 |
| 7,218,821 | B2 | 5/2007 | Bocanegra et al. | | |
| 7,462,781 | B2 | 12/2008 | Varkey et al. | | |
| 8,486,527 | B2 | 7/2013 | Hager et al. | | |
| 2004/0124001 | A1 * | 7/2004 | Sanders | G01K 11/32 | 174/128.1 |
| 2005/0045367 | A1 * | 3/2005 | Somers | H01B 11/04 | 174/113 R |
| 2008/0164049 | A1 * | 7/2008 | Vexler | H01B 11/06 | 174/113 |
| 2012/0103646 | A1 * | 5/2012 | Fox | H01B 9/028 | 174/34 |
| 2012/0103652 | A1 * | 5/2012 | Ooyama | H01B 11/1091 | 174/105 R |
| 2013/0202262 | A1 | 8/2013 | Haymore | | |
| 2014/0270649 | A1 | 9/2014 | Ray et al. | | |

OTHER PUBLICATIONS

"Multiple-conductor cable using non-integral jacket" UL iQ for Appliance Writing Materials, Sec. 5, p. 5410; http://data.ul.com/link/stylepage.aspx?style=5410, issued Dec. 18, 2003, 2 pages.

"Multiple-conductor cable using non-integral jacket" UL iQ for Appliance Writing Materials,Sec. 2, p. 2661; http://data.ul.com/link/stylepage.aspx?style=2661, issued Sep. 21, 1973, 2 pages.

* cited by examiner

CABLE WITH SPRING STEEL OR OTHER REINFORCEMENT MEMBER(S) FOR STABLE ROUTING BETWEEN SUPPORT POINTS

TECHNICAL FIELD

This disclosure is generally directed to cables for transporting electrical or other signals. More specifically, this disclosure is directed to a cable with one or more spring steel or other reinforcement members for stable routing between support points.

BACKGROUND

Numerous types of cables have been developed over the years to transport electrical, optical, or other signals. In some instances, cables are connected to movable components and can facilitate communications to or from the movable components. These types of wiring applications often present difficult challenges to both (i) harness designers who develop systems that use cables connected to movable components and (ii) wiring materials designers who develop materials used in the cables connected to the movable components.

In some conventional approaches, external layers of support materials are added to cables in order to address environmental and mechanical support issues that affect the cables. However, the base wiring in a cable could include only a small number of electrical wires, such as two or three wires for a basic position switch. These conventional approaches typically add significant bulk and weight to the base wiring, and the resulting cable design is often many times the size and weight of the base wiring.

SUMMARY

This disclosure provides a cable with one or more spring steel or other reinforcement members for stable routing between support points.

In a first embodiment, an apparatus includes a cable having at least one signal transport line and at least one reinforcement member. The at least one signal transport line is configured to transport one or more signals through the cable. The at least one signal transport line and the at least one reinforcement member are twisted in a common direction around a central axis of the cable, where the central axis extends in a longitudinal direction along a length of the cable. A twist rate of the at least one signal transport line substantially equals a twist rate of the at least one reinforcement member. At least part of each signal transport line is physically located between adjacent twists of each reinforcement member in the longitudinal direction of the cable.

In a second embodiment, a system includes a support structure, a movable structure, and a cable coupled to the movable structure and mounted to the support structure. The cable includes at least one signal transport line and at least one reinforcement member, where the at least one signal transport line is configured to transport one or more signals through the cable. The at least one signal transport line and the at least one reinforcement member are twisted in a common direction around a central axis of the cable, where the central axis extends in a longitudinal direction along a length of the cable. A twist rate of the at least one signal transport line substantially equals a twist rate of the at least one reinforcement member. At least part of each signal transport line is physically located between adjacent twists of each reinforcement member in the longitudinal direction of the cable.

In a third embodiment, a method includes twisting at least one reinforcement member around a central axis, where the central axis extends in a longitudinal direction along a length of a cable being formed. The method also includes twisting at least one signal transport line around the central axis, where the at least one signal transport line is configured to transport one or more signals through the cable. The at least one signal transport line and the at least one reinforcement member are twisted in a common direction around the central axis. A twist rate of the at least one signal transport line substantially equals a twist rate of the at least one reinforcement member. At least part of each signal transport line is physically located between adjacent twists of each reinforcement member in the longitudinal direction of the cable.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 5, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

Figure 1:
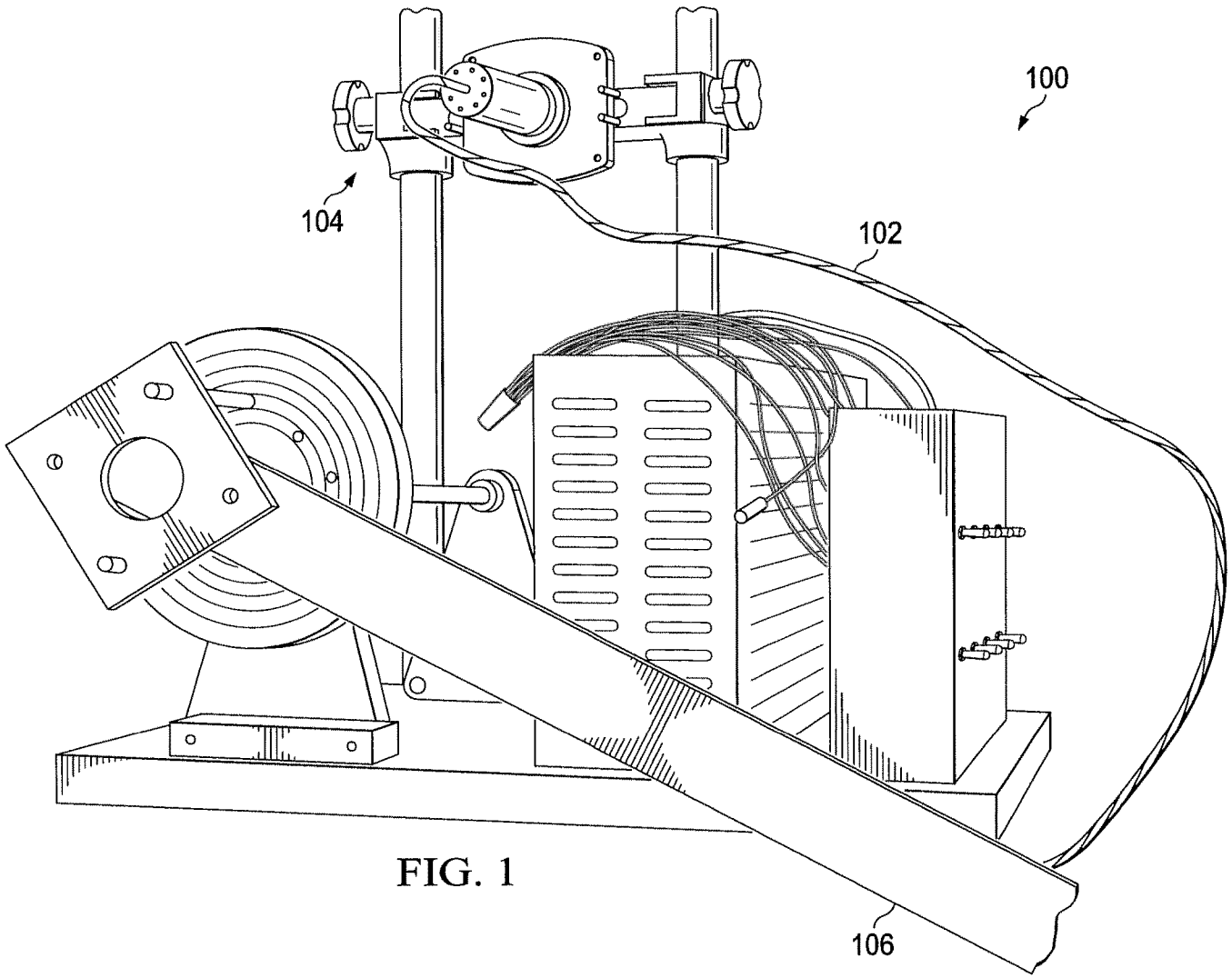
FIG. 1 illustrates an example system with a cable having spring steel or other reinforcement according to this disclosure.

FIG. 1 illustrates an example system 100 with a cable 102 having spring steel or other reinforcement according to this disclosure. As shown in FIG. 1, the cable 102 extends between a movable object 104 and at least one support 106. The movable object 104 here denotes a structure that can slide up and down on a pair of vertical rails. However, the movable object 104 could denote any other suitable structure that can move back and forth. For example, in some embodiments, the cable 102 can be used in conjunction with a wing flap of an aircraft.

The support 106 denotes a structure where a clamp, guide, or other device can be coupled to the structure and used to retain the cable 102 in a specified location. Although a single support 106 is shown here, clamps, guides, or other devices on multiple supports 106 could be used to retain the cable 102 at multiple locations. While shown as a single rectangular piece of material here, the support 106 could denote any other suitable structure to which the cable 102 can be mounted. For example, in some embodiments, the cable 102 can be mounted to structural supports in a wing or body of an aircraft.

The cable 102 is designed to satisfy electrical and environmental requirements associated with its use in a particular environment. Moreover, the cable 102 can accomplish this while being attached to the movable object 104 and with potentially long distances between clamp points (a clamp point denotes a point where the cable 102 is clamped or otherwise secured to a support using a guide, clamp, or other structure). This is accomplished by using one or more reinforcement members within the cable 102. The reinforcement members denote spring steel members or other members (such as aluminum members or non-metallic members such as nylon or PEEK members) that are twisted along the length of the cable 102. Note that the reinforcement members could be formed from electrically conducting material(s) such as steel, but the reinforcement members need not be used to transport electrical or other signals through the cable 102.

The use of one or more reinforcement members provides form and support for the cable 102. For example, the reinforcement members provide internal support within the cable 102 and allow the cable 102 to form a predictable path through a given space between support points. In the example shown in FIG. 1, for instance, the cable 102 can maintain the illustrated path for a prolonged period of time with little or no sagging. The reinforcement members also provide controllable bending, bending consistency, and high flex life to the cable 102.

This type of cable 102 can be advantageously used in various circumstances. For example, this type of cable 102 could be used to couple one or more aircraft systems to movable wing flaps in commercial or military aircraft. In these types of aircraft, space is limited, and safety margins are small. The internal support provided by the cable 102 helps to ensure that the cable 102 can be coupled to a wing flap in the small space provided without sagging into unsafe or undesired locations in the aircraft wing. This type of cable 102 also allows for greater spacing between clamping points under appropriate conditions. This can also be of great benefit in certain routing conditions, particularly where there are gaps in a support structure so that clamps, guides, or other hardware is spaced apart.

Note that the cable 102 could include a single twisted reinforcement member or multiple twisted reinforcement members. Additional details regarding different implementations of the cable 102 are provided below.

Although FIG. 1 illustrates one example of a system 100 with a cable 102 having spring steel or other reinforcement, various changes may be made to FIG. 1. For example, the cable 102 could be used with any suitable movable object(s) and support(s). Also, a cable 102 could be mounted along any number of support structures. In addition, multiple cables 102 could be coupled to the same movable object.

Figure 2:
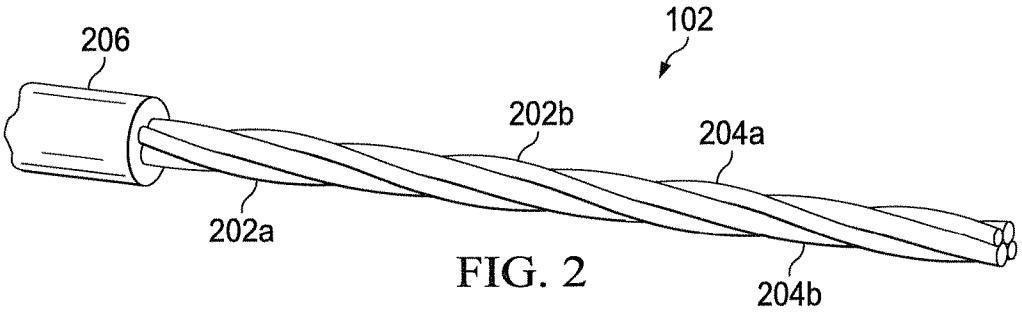
FIG. 2 illustrates an example cable having spring steel or other reinforcement according to this disclosure.

FIG. 2 illustrates an example cable 102 having spring steel or other reinforcement according to this disclosure. As shown in FIG. 2, the cable 102 includes one or more signal transport lines 202*a*-202*b* and one or more reinforcement members 204*a*-204*b*. Note that the number of signal transport lines and the number of reinforcement members in FIG. 2 is for illustration only. Each signal transport line 202*a*-202*b* denotes a structure along which electrical, optical, or other signals are transported. Each reinforcement member 204*a*-204*b* denotes a structure providing structural support for the cable 102 but along which no electrical, optical, or other signals may be transported.

A shield and jacket (collectively identified using reference numeral 206) extend over the signal transport lines 202*a*-202*b* and the reinforcement members 204*a*-204*b*. The shield could represent a braid shield or other structure designed to reduce interference in the cable 102 and/or reduce interference caused by the cable 102. The jacket could represent an insulative or other protective cover formed around the signal transport lines 202*a*-202*b*, the reinforcement members 204*a*-204*b*, and the shield.

The reinforcement members 204*a*-204*b* shown here are twisted in the same direction, rather than being twisted in opposite directions. The signal transport lines 202*a*-202*b* are also twisted in the same direction as the reinforcement members 204*a*-204*b*. Effectively, all of the signal transport lines 202*a*-202*b* and the reinforcement members 204*a*-204*b* are twisted around a central longitudinal axis of the cable 102 in the same direction (the central longitudinal axis extends in the longitudinal direction along the length of the cable 102).

Because of this, the twisted reinforcement members 204*a*-204*b* here do not form a core of the cable 102, where the signal transport lines 202*a*-202*b* are twisted around the core at a farther distance from the central longitudinal axis of the cable 102. Also, the twisted reinforcement members 204*a*-204*b* do not foam a braid or other shield around the signal transport lines 202*a*-202*b* of the cable 102. Rather, the reinforcement members 204*a*-204*b* are twisted at substantially the same twist rate as the signal transport lines 202*a*-202*b* within the cable 102, where the twist rate denotes the number of times that a signal transport line or reinforcement member is twisted around the longitudinal axis of the cable 102 per some given length. Moreover, the twists of the reinforcement members 204*a*-204*b* mesh with the twists of the signal transport lines 202*a*-202*b*. Among other things, this allows the signal transport lines 202*a*-202*b* to fit at least partially within spaces between the reinforcement members 204*a*-204*b*. As can be seen in FIG. 2, the diameter of the twisted reinforcement members 204*a*-204*b* is substantially equal to the diameter of the twisted signal transport lines 202*a*-202*b*, although the diameters of the twisted signal transport lines 202*a*-202*b* and the twisted reinforcement members 204*a*-204*b* could vary as desired.

Note that the reinforcement members 204*a*-204*b* may or may not be insulated. When the reinforcement members 204*a*-204*b* are not used to transport signals, there may be no need to provide insulation around the reinforcement members 204*a*-204*b*.

In the example shown in FIG. 2, two signal transport lines 202*a*-202*b* are twisted with two reinforcement members 204*a*-204*b* as a quad. The shield could then be braided or otherwise formed over the signal transport lines 202*a*-202*b* and the reinforcement members 204*a*-204*b*, and the jacket can be extruded or otherwise formed over the structure. The resulting cable 102 performs electrically as a normal shielded twisted pair cable but has internal support. Among other things, the internal support can help to prevent significant sagging of the cable 102 between clamping points.

Figure 4:
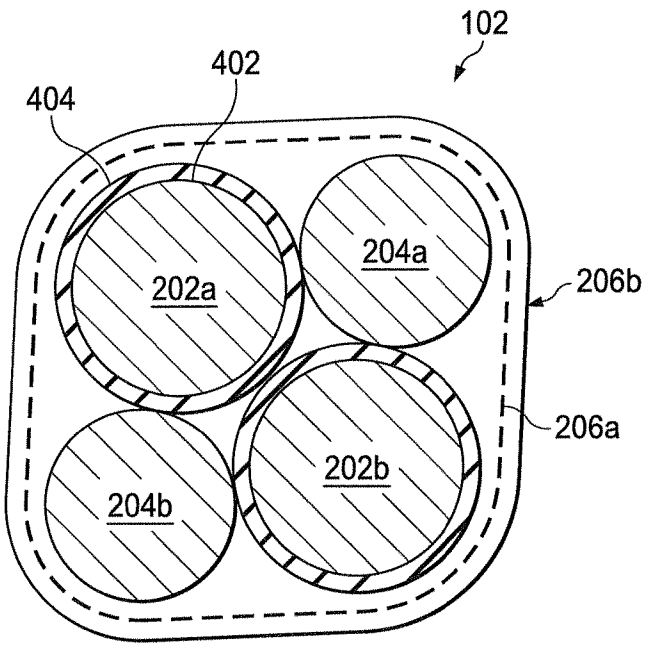
FIGS. 3 and 4 illustrate example cross-sections of a cable having spring steel or other reinforcement according to this disclosure.
Figure 3:
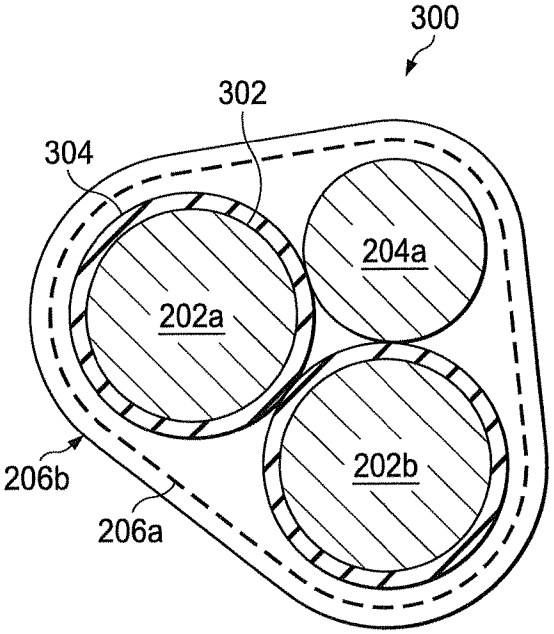

FIGS. 3 and 4 illustrate example cross-sections 300 and 400 of a cable 102 having spring steel or other reinforcement according to this disclosure. For ease of explanation, the cross-sections 300 and 400 are described with respect to the cable 102 of FIG. 2 operating in the system 100 of FIG. 1. However, the cross-sections 300 and 400 shown here could be used in any other suitable cable and in any other suitable environment.

As shown in FIG. 3, the cross-section 300 includes two signal transport lines 202*a*-202*b* and a single reinforcement member 204*a* disposed within the shield 206*a* and jacket 206*b*. In this example, each signal transport line 202*a*-202*b* includes a conductive core 302 and an insulative cover 304. The transport lines 202*a*-202*b* and the reinforcement member 204*a* can all be twisted around the central longitudinal axis of the cable 102. As a result, at least parts of the signal transport lines 202*a*-202*b* are positioned within longitudinal spaces between adjacent twists of the reinforcement member 204*a*. That is, the reinforcement member 204*a* is twisted longitudinally around the central axis of the cable 102, and at least parts of the signal transport lines 202*a*-202*b* are located physically between adjacent twists of the reinforcement member 204*a* in the longitudinal direction.

As shown in FIG. 4, the cross-section 400 includes two signal transport lines 202*a*-202*b* and two reinforcement members 204*a*-204*b* disposed within the shield 206*a* and the jacket 206*b*. Each signal transport line 202*a*-202*b* includes a conductive core 402 and an insulative cover 404. The transport lines 202*a*-202*b* and the reinforcement members 204*a*-204*b* can all be twisted around the central longitudinal axis of the cable 102. As a result, at least parts of the signal transport lines 202*a*-202*b* are positioned within longitudinal spaces between adjacent twists of the reinforcement members 204*a*-204*b* in the longitudinal direction of the cable 102. Moreover, at least parts of the signal transport lines 202*a*-202*b* are positioned within the space between the reinforcement members 204*a*-204*b* themselves.

Although FIG. 2 illustrates one example of a cable 102 having spring steel or other reinforcement and FIGS. 3 and 4 illustrate examples of cross-sections 300 and 400 of the cable 102, various changes may be made to FIGS. 2 through 4. For example, the numbers and sizes of the signal transport lines 202*a*-202*b* and reinforcement members 204*a*-204*b* are for illustration only. In general, the cable 102 could include one or more signal transport lines and one or more reinforcement members.

Figure 5:
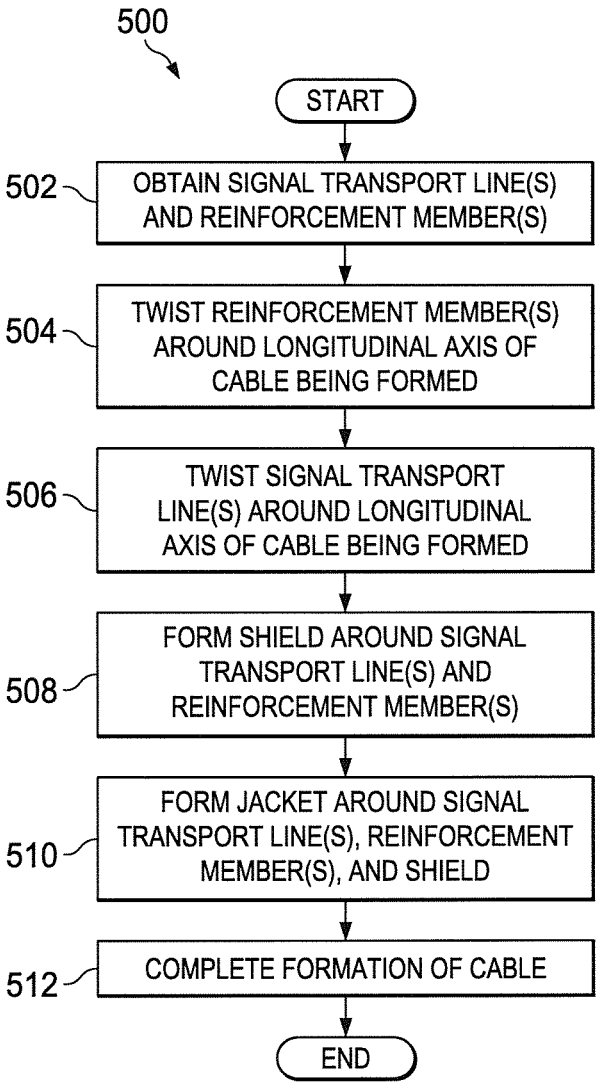
FIG. 5 illustrates an example method for forming a cable having spring steel or other reinforcement according to this disclosure.

FIG. 5 illustrates an example method 500 for forming a cable having spring steel or other reinforcement according to this disclosure. For ease of explanation, the method 500 is described with respect to the cable 102 of FIG. 2 having one of the cross-sections 300 and 400 shown in FIGS. 3 and 4. However, the method 500 shown here could be used to fabricate any other suitable cable having any other suitable cross-section.

As shown in FIG. 5, one or more signal transport lines and one or more reinforcement members are obtained at step 502. This could include, for example, manufacturing, purchasing, or otherwise obtaining one or more electrical, optical, or other conductors to be used as the signal transport line(s). This could also include manufacturing, purchasing, or otherwise obtaining one or more spring steel members or other members to be used as the reinforcement member(s).

The one or more reinforcement members are twisted around a longitudinal axis of a cable being formed at step 504. This could include, for example, heating the spring steel or other members, wrapping the heated members around a cylindrical object, and allowing the heated members to cool. If multiple spring steel or other members are being used, the spring steel or other members are twisted in the same direction around the longitudinal axis. Note that twisting the reinforcement members before the signal transport lines are twisted can help to avoid imparting unnecessary stresses on the signal transport lines or damaging the signal transport lines during fabrication of the cable 102.

The one or more signal transport lines are twisted around the longitudinal axis of the cable being formed at step 506. This could include, for example, wrapping the signal transport line(s) in the same direction around the longitudinal axis as the reinforcement member(s). Each signal transport line fits at least partially within the longitudinal spaces between adjacent twists of each reinforcement member in the longitudinal direction of the cable 102. If multiple reinforcement members are used, each signal transport line can also fit at least partially within the space between the reinforcement members themselves.

If desired, a shield is formed around the signal transport line(s) and the reinforcement member(s) at step 508. This could include, for example, forming a braid shield or other shield around the twisted signal transport line(s) and the twisted reinforcement member(s). The shield could be formed from any suitable material(s) and in any suitable manner. A jacket is formed around the signal transport line(s), the reinforcement member(s), and the shield at step 510. This could include, for example, extruding one or more insulative materials over the signal transport line(s), the reinforcement member(s), and the shield. The jacket could be formed from any suitable material(s) and in any suitable manner.

Formation of the cable is completed at step 512. This could include, for example, coupling connectors to opposite ends of the cable 102. Any suitable connectors could be used with the cable depending (at least in part) on the type(s) and number(s) of signal transport line(s) used in the cable 102.

Although FIG. 5 illustrates one example of a method 500 for forming a cable having spring steel or other reinforcement, various changes may be made to FIG. 5. For example, while shown as a series of steps, various steps in FIG. 5 could overlap, occur in parallel, occur in a different order, or occur any number of times.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a cable comprising at least one signal transport line and at least one reinforcement member, the at least one signal transport line configured to transport one or more signals through the cable;

wherein the at least one signal transport line and the at least one reinforcement member are twisted in a common direction around a central axis of the cable, the central axis extending in a longitudinal direction along a length of the cable;

wherein a twist rate of the at least one signal transport line substantially equals a twist rate of the at least one reinforcement member; and wherein at least part of each signal transport line is physically located between adjacent twists of each reinforcement member in the longitudinal direction of the cable.

2. The apparatus of claim 1, wherein:

the at least one signal transport line represents two electrical conductors; and the at least one reinforcement member represents a single reinforcement member.

3. The apparatus of claim 1, wherein:

the at least one signal transport line represents two electrical conductors;

the at least one reinforcement member represents two reinforcement members; and at least part of each electrical conductor is physically located between the two reinforcement members.

4. The apparatus of claim 1, wherein the at least one reinforcement member comprises spring steel.

5. The apparatus of claim 1, wherein the at least one reinforcement member is configured to provide form, support, and bending consistency to the cable.

6. The apparatus of claim 1, wherein a diameter of the at least one reinforcement member as twisted is substantially equal to a diameter of the at least one signal transport line as twisted.

7. The apparatus of claim 1, wherein the cable further comprises at least one of:

a shield around the at least one signal transport line and the at least one reinforcement member; and a jacket around the at least one signal transport line and the at least one reinforcement member.

8. A system comprising:

a support structure;

a movable structure; and a cable coupled to the movable structure and mounted to the support structure;

wherein the cable comprises at least one signal transport line and at least one reinforcement member, the at least one signal transport line configured to transport one or more signals through the cable;

wherein the at least one signal transport line and the at least one reinforcement member are twisted in a common direction around a central axis of the cable, the central axis extending in a longitudinal direction along a length of the cable;

wherein a twist rate of the at least one signal transport line substantially equals a twist rate of the at least one reinforcement member; and wherein at least part of each signal transport line is physically located between adjacent twists of each reinforcement member in the longitudinal direction of the cable.

9. The system of claim 8, wherein:

the at least one signal transport line represents two electrical conductors; and the at least one reinforcement member represents a single reinforcement member.

10. The system of claim 8, wherein:

the at least one signal transport line represents two electrical conductors;

the at least one reinforcement member represents two reinforcement members; and at least part of each electrical conductor is physically located between the two reinforcement members.

11. The system of claim 8, wherein the at least one reinforcement member comprises spring steel.

12. The system of claim 8, wherein the at least one reinforcement member is configured to provide form, support, and bending consistency to the cable.

13. The system of claim 8, wherein a diameter of the at least one reinforcement member as twisted is substantially equal to a diameter of the at least one signal transport line as twisted.

14. The system of claim 8, wherein the cable further comprises at least one of:

a shield around the at least one signal transport line and the at least one reinforcement member; and a jacket around the at least one signal transport line and the at least one reinforcement member.

15. The system of claim 8, wherein:

the at least one reinforcement member is not insulated; and the at least one reinforcement member does not transport any signals through the cable.

16. A method comprising:

twisting at least one reinforcement member around a central axis, the central axis extending in a longitudinal direction along a length of a cable being formed; and twisting at least one signal transport line around the central axis, the at least one signal transport line configured to transport one or more signals through the cable;

wherein the at least one signal transport line and the at least one reinforcement member are twisted in a common direction around the central axis;

wherein a twist rate of the at least one signal transport line substantially equals a twist rate of the at least one reinforcement member; and wherein at least part of each signal transport line is physically located between adjacent twists of each reinforcement member in the longitudinal direction of the cable.

17. The method of claim 16, wherein:

the at least one signal transport line represents two electrical conductors; and the at least one reinforcement member represents a single reinforcement member.

18. The method of claim 16, wherein:

the at least one signal transport line represents two electrical conductors;

the at least one reinforcement member represents two reinforcement members; and at least part of each electrical conductor is physically located between the two reinforcement members.

19. The method of claim 16, wherein the at least one reinforcement member comprises spring steel.

20. The method of claim 16, further comprising:

forming a shield around the at least one signal transport line and the at least one reinforcement member; and Raining a jacket around the shield.

* * * * *